US011211005B2

(12) United States Patent
Hu et al.

(10) Patent No.: US 11,211,005 B2
(45) Date of Patent: Dec. 28, 2021

(54) PIXEL DRIVING CIRCUIT, DISPLAY DEVICE AND DRIVING METHOD

(71) Applicants: BOE Technology Group Co., Ltd., Beijing (CN); Hefei Xinsheng Optoelectronics Technology Co., Ltd., Anhui (CN)

(72) Inventors: Zuquan Hu, Beijing (CN); Xiping Wang, Beijing (CN)

(73) Assignees: BOE Technology Group Co., Ltd., Beijing (CN); Hefei Xinsheng Optoelectronics Technology Co., Ltd., Anhui (CN)

( * ) Notice: Subject to any disclaimer, the term of this patent is extended or adjusted under 35 U.S.C. 154(b) by 811 days.

(21) Appl. No.: 16/061,593

(22) PCT Filed: Nov. 14, 2017

(86) PCT No.: PCT/CN2017/110793
§ 371 (c)(1),
(2) Date: Jun. 12, 2018

(87) PCT Pub. No.: WO2018/209909
PCT Pub. Date: Nov. 22, 2018

(65) Prior Publication Data

US 2021/0201788 A1 Jul. 1, 2021

(30) Foreign Application Priority Data

May 17, 2017 (CN) ..... 201710349239.3

(51) Int. Cl.
*G06F 3/038* (2013.01)
*G09G 5/00* (2006.01)
(Continued)

(52) U.S. Cl.
CPC ..... *G09G 3/3258* (2013.01); *G09G 3/3275* (2013.01)

(58) Field of Classification Search
None
See application file for complete search history.

(56) References Cited

U.S. PATENT DOCUMENTS 9,704,435 B2 7/2017 Chen et al.
9,886,906 B2 2/2018 Tan et al.
(Continued)

FOREIGN PATENT DOCUMENTS

CN 102789761 A 11/2012
CN 104036724 A 9/2014
(Continued)

OTHER PUBLICATIONS

Feb. 14, 2018—(WO) International Search Report and Written Opinion Appn PCT/CN2017/110793 with English Translation.

*Primary Examiner* — Kirk W Hermann
(74) *Attorney, Agent, or Firm* — Banner & Witcoff, Ltd.

(57) ABSTRACT

A pixel driving circuit includes a control sub-circuit, a charging sub-circuit, a driving sub-circuit and a light-emitting sub-circuit, the control sub-circuit is used to control a first thin film transistor to charge the charging sub-circuit, and the charging sub-circuit is used to provide a voltage to the driving sub-circuit to drive the light-emitting sub-circuit to emit light.

13 Claims, 7 Drawing Sheets

(51) Int. Cl.
*G09G 3/3258* (2016.01)
*G09G 3/3275* (2016.01)

(56) References Cited

U.S. PATENT DOCUMENTS

| | | | | |
|---|---|---|---|---|
| 2014/0354713 | A1 | 12/2014 | Kim et al. | |
| 2015/0371586 | A1* | 12/2015 | Chen | G09G 3/3233 345/78 |
| 2015/0371587 | A1* | 12/2015 | Chen | G09G 3/3233 345/76 |
| 2016/0300532 | A1* | 10/2016 | Tan | G09G 3/3233 |
| 2017/0178571 | A1 | 6/2017 | Kang et al. | |

FOREIGN PATENT DOCUMENTS

| | | | |
|---|---|---|---|
| CN | 104064146 | A | 9/2014 |
| CN | 106910458 | A | 6/2017 |
| CN | 106935204 | A | 7/2017 |

* cited by examiner

PIXEL DRIVING CIRCUIT, DISPLAY DEVICE AND DRIVING METHOD

The application is a U.S. National Phase Entry of International Application No. PCT/CN2017/110793 filed on Nov. 14, 2017, designating the United States of America and claiming priority to Chinese Patent Application No. 201710349239.3, filed on May 17, 2017. The present application claims priority to and the benefit of the above-identified applications and the above-identified applications are incorporated by reference herein in their entirety.

TECHNICAL FIELD

Embodiments of the present disclosure relate to a pixel driving circuit, a display device and a driving method.

BACKGROUND

With the progress of display technology, more and more active matrix organic light emitting diode display panels (AMOLEDs) enter the market, compared with traditional thin film transistor liquid crystal display panels, the AMOLEDs have advantages, such as faster response speed, higher contrast, wider viewing angles and thinner modules, and therefore, the AMOLEDs are getting more and more attention from panel manufacturers.

In a writing stage, the control line G_N is at a high level, the second thin film transistor 52 and the third thin film transistor 53 are turned on, a signal current on the data line I_oled is written into a gate electrode of the first thin film transistor 51 via the second thin film transistor 52 and the third thin film transistor 53, meanwhile the signal current charges the storage capacitor 55 through a source electrode and a drain electrode of the first thin film transistor 51. Because the control signal line S1 is at a low level so that the fourth thin film transistor 54 is turned off, the first power supply Vdd and the second power supply Vss can not form a loop, the organic light-emitting diode (OLED) does not emit light. At this time, a node A is short-circuited to the drain electrode of the first thin film transistor 51, and due to a self-regulating effect of the first thin film transistor 51, the signal current flows to the second power supply Vss through the drain electrode and the source electrode of the first thin film transistor 51. In a light-emitting stage, the control line G_N is at a low level, the second thin film transistor 52 and the third thin film transistor 53 are turned off, because of the charge retention effect of the storage capacitor 55, the first thin film transistor 51 is at a saturation turn-on state, the control signal line S1 is at a high level, the fourth thin film transistor 54 is turned on, the first power supply Vdd and the second power supply Vss form a loop, the signal current is completely duplicated as a driving signal current and is provided to the OLED 56 to drive the OLED 56 to emit light.

SUMMARY

Embodiments of the present disclosure provide a pixel driving circuit, a display device and a driving method so as to solve problems that power consumption in an existing pixel driving circuit is high, the wire routing in the OLED display panel is complicated, and the production yield is low.

An embodiment of the present disclosure provides a pixel driving circuit, which comprises: a control sub-circuit, a charging sub-circuit, a driving sub-circuit and a light-emitting sub-circuit. The control sub-circuit is connected with a data line and a control line, the control sub-circuit is connected with the driving sub-circuit through a first node and a second node; the charging sub-circuit is connected with the driving sub-circuit through the first node and a third node; a first end of the light-emitting sub-circuit is connected with the driving sub-circuit, a second end of the light-emitting sub-circuit is connected with a first power supply or a second power supply; the driving sub-circuit comprises a first thin film transistor; the control sub-circuit is configured to control the first thin film transistor to charge the charging sub-circuit through the first node and the third node, the charging sub-circuit is configured to provide a voltage to the driving sub-circuit through the first node, and the driving sub-circuit is configured to drive the light-emitting sub-circuit to emit light.

For example, in the pixel driving circuit provided by an embodiment of the present disclosure, the charging sub-circuit comprises a storage capacitor, a first end of the storage capacitor is connected with the first node, a second end of the storage capacitor is connected with the third node, and the third node is connected with the second power supply.

For example, in the pixel driving circuit provided by an embodiment of the present disclosure, a gate electrode of the first thin film transistor of the driving sub-circuit is connected with the first node, a source electrode of the first thin film transistor is connected with the third node, and a drain electrode of the first thin film transistor is connected with the second node.

For example, in the pixel driving circuit provided by an embodiment of the present disclosure, the light-emitting sub-circuit comprises a light-emitting component, a cathode of the light-emitting component is connected with the second node, and an anode of the light-emitting component is connected with the first power supply.

For example, in the pixel driving circuit provided by an embodiment of the present disclosure, the control sub-circuit comprises a second thin film transistor and a third thin film transistor, a gate electrode of the second thin film transistor and a gate electrode of the third thin film transistor are connected with each other, and are connected with the control line; a drain electrode of the second thin film transistor is connected with the data line; a source electrode of the second thin film transistor, a drain electrode of the third thin film transistor are connected with the first node; and a source electrode of the third thin film transistor is connected with the second node.

For example, in the pixel driving circuit provided by an embodiment of the present disclosure, the control sub-circuit further comprises a fourth thin film transistor, a gate electrode of the fourth thin film transistor is connected with the gate electrode of the second thin film transistor and the gate electrode of the third thin film transistor; a source electrode of the fourth thin film transistor is connected with the second node; and a drain electrode of the fourth thin film transistor is connected with the first power supply.

For example, in the pixel driving circuit provided by an embodiment of the present disclosure, the control sub-circuit comprises a second thin film transistor, a third thin film transistor and a fourth thin film transistor; a gate electrode of the second thin film transistor, a gate electrode of the third thin film transistor and a gate electrode of the fourth thin film transistor are connected, and are connected with the control line; a drain electrode of the second thin film transistor is connected with the data line; a source electrode of the second thin film transistor and a drain electrode of the third thin film transistor are connected with the first node; a source electrode of the third thin film transistor is connected with the second node; the second node is connected with the first power supply; a drain electrode of the fourth thin film transistor is connected with the third node, and a source electrode of the fourth thin film transistor is connected with the second power supply.

For example, in the pixel driving circuit provided by an embodiment of the present disclosure, the light-emitting sub-circuit comprises a light-emitting component, an anode of the light-emitting component is connected with the third node, and a cathode of the light-emitting component is connected with the second power supply.

An embodiment of the present disclosure further provides a display device, which comprises the pixel driving circuit provided by any one of the embodiments of the present disclosure.

An embodiment of the present disclosure further provides a driving method of a pixel driving circuit, the pixel driving circuit comprises a control sub-circuit, a charging sub-circuit, a driving sub-circuit and a light-emitting sub-circuit, the driving method comprises: controlling the driving sub-circuit to charge the charging sub-circuit by the control sub-circuit; and providing a voltage to the driving sub-circuit by the charging sub-circuit so as to drive the light-emitting sub-circuit to emit light.

For example, in the driving method provided by an embodiment of the present disclosure, the control sub-circuit comprises a second thin film transistor and a third thin film transistor, the driving sub-circuit comprises a first thin film transistor, the charging sub-circuit comprises a storage capacitor, controlling the driving sub-circuit to charge the charging sub-circuit by the control sub-circuit comprises: providing a high level signal by the control line so as to turn on the second thin film transistor and the third thin film transistor; and providing a signal current by the data line, the signal current charging the storage capacitor through a gate electrode and a source electrode of the first thin film transistor.

For example, in the driving method provided by an embodiment of the present disclosure, providing the voltage to the driving sub-circuit by the charging sub-circuit to drive the light-emitting sub-circuit to emit light comprises: providing a low level signal by the control line so as to turn off the second thin film transistor and the third thin film transistor; providing a high level signal to a gate electrode of the first thin film transistor by the storage capacitor so as to turn on the first thin film transistor; and providing a high level signal by the first power supply so as to drive the light-emitting sub-circuit to emit light.

For example, in the driving method provided by an embodiment of the present disclosure, the control sub-circuit comprises a second thin film transistor, a third thin film transistor and a fourth thin film transistor, the driving sub-circuit comprises a first thin film transistor, the charging sub-circuit comprises a storage capacitor, controlling the driving sub-circuit to charge the charging sub-circuit by the control sub-circuit comprises: providing a high level signal by the control line so as to turn on the second thin film transistor, the third thin film transistor and the fourth thin film transistor; providing a signal current by the data line, the signal current charging the storage capacitor through a gate electrode and a source electrode of the first thin film transistor.

For example, in the driving method provided by an embodiment of the present disclosure, providing the voltage to the driving sub-circuit by the charging sub-circuit so as to drive the light-emitting sub-circuit to emit light comprises: providing a low level signal by the control line so as to turn off the second thin film transistor, the third thin film transistor and the fourth thin film transistor; providing a high level signal to a gate electrode of the first thin film transistor through the storage capacitor so as to turn on the first thin film transistor; and providing a high level signal by the first power supply so as to drive the light-emitting sub-circuit to emit light.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects.

Figure 1:
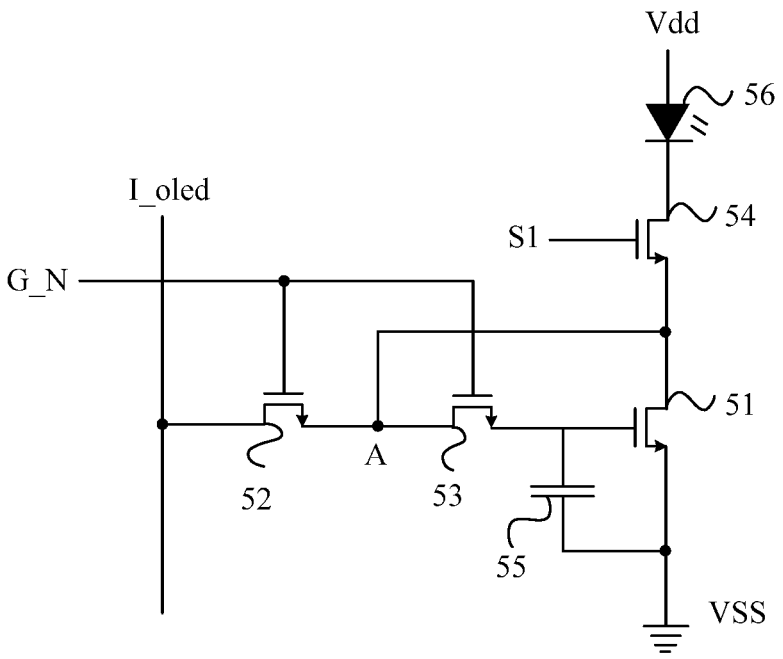
FIG. 1 is a structural schematic diagram of a pixel driving circuit.

FIG. 1 shows a structure of a pixel driving circuit, the pixel driving circuit comprises a first thin film transistor 51, a second thin film transistor 52, a third thin film transistor 53, a fourth thin film transistor 54, a storage capacitor 55, a first power supply Vdd, a second power supply Vss, a data line I_oled, a control lin G_N, and a control signal line S1, and a working principle of the pixel driving circuit is as follows:

In a writing stage, the control line G_N is at a high level, the second thin film transistor 52 and the third thin film transistor 53 are turned on, a signal current on the data line I_oled is written into a gate electrode of the first thin film transistor 51 via the second thin film transistor 52 and the third thin film transistor 53, meanwhile the signal current charges the storage capacitor 55 through a source electrode and a drain electrode of the first thin film transistor 51. Because the control signal line S1 is at a low level so that the four thin film transistor 54 is turned off, the first power supply Vdd and the second power supply Vss can not form a loop, the organic light-emitting diode (OLED) does not emit light. At this time, a node A is short-circuited to the drain electrode of the first thin film transistor 51, and due to a self-regulating effect of the first thin film transistor 51, the signal current flows to the second power supply Vss through the drain electrode and the source electrode of the first thin film transistor 51. In a light-emitting stage, the control line G_N is at a low level, the second thin film transistor 52 and the third thin film transistor 53 are turned off, because of the charge retention effect of the storage capacitor 55, the first thin film transistor 51 is at a saturation turn-on state, the control signal line S1 is at a high level, the fourth thin film transistor 54 is turned on, the first power supply Vdd and the second power supply Vss form a loop, the signal current is completely duplicated as a driving signal current and is provided to the OLED 56 to drive the OLED 56 to emit light.

On one hand, in the light-emitting stage, the fourth thin film transistor 54 is connected in series in the loop formed by the first power supply Vdd and the second power supply Vss, and the fourth thin film transistor 54 has a resistance R when the fourth thin film transistor 54 is linearly turned on, so that when the OLED 56 continues to emit light, electric energy consumed by the fourth thin film transistor 54 is $I^2R$, where I is the signal current. For each OLED pixel, a resistor R exists, resulting in power loss of the entire display panel. On the other hand, the OLED display panel is provided with the control signal line S1 to control the fourth thin film transistor 54, so that the number of the signal lines increases, as a result, the wire routing of the OLED display panel is complicated, and the production yield is reduced.

Figure 2:
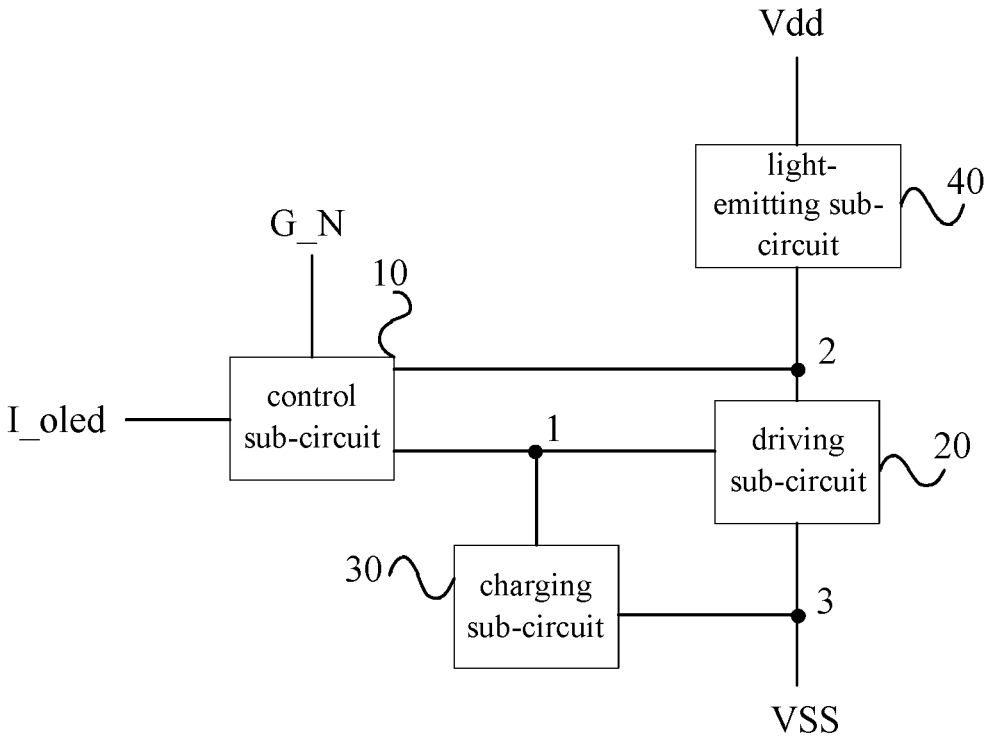
FIG. 2 is a schematic diagram of a pixel driving circuit provided by an embodiment of the present disclosure.

FIG. 2 is a schematic diagram of a pixel driving circuit provided by an embodiment of the present disclosure.

For example, as illustrated in FIG. 2, a pixel driving circuit provided by an embodiment of the present disclosure comprises: a control sub-circuit 10, a charging sub-circuit 30, a driving sub-circuit 20 and a light-emitting sub-circuit 40, the control sub-circuit 10 is connected with a data line I_oled and a control line G_N, the control sub-circuit 10 is connected with the driving sub-circuit 20 through a first node 1 and a second node 2, the charging sub-circuit 30 is connected with the driving sub-circuit 20 through the first node 1 and a third node 3, the driving sub-circuit 20 is connected with a first end of the light-emitting sub-circuit 40, a second end of the light-emitting sub-circuit 40 is connected with a first power supply Vdd or a second power supply Vss, and the driving sub-circuit 20 comprises a first thin film transistor.

A working principle of the pixel driving circuit provided by the embodiment of the present disclosure is: the control sub-circuit 10 controls the first thin film transistor of the driving sub-circuit 20 to charge the charging sub-circuit 30 through the first node 1 and the third node 3, the charging sub-circuit 30 provides a voltage to the driving sub-circuit through the first node 1, and the driving sub-circuit 20 is used to drive the light-emitting sub-circuit 40 to emit light.

Figure 3:
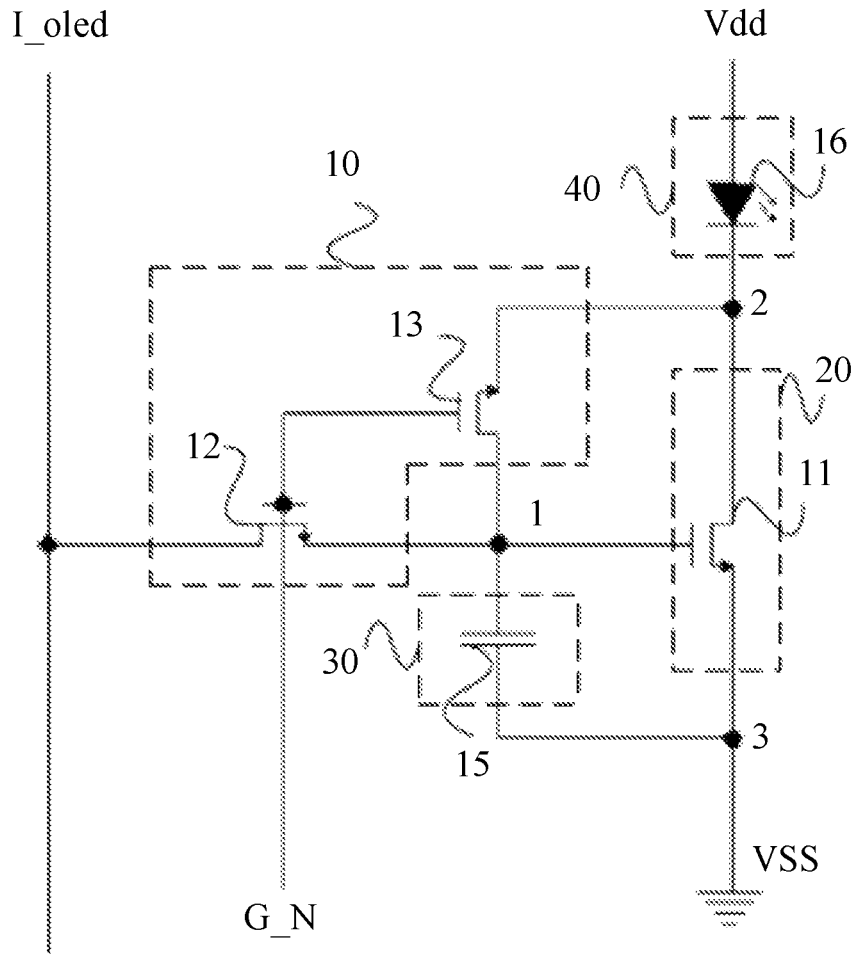
FIG. 3 is a structural schematic diagram of a pixel driving circuit provided by an embodiment of the present disclosure.

FIG. 3 is a structural schematic diagram of a pixel driving circuit provided by an embodiment of the present disclosure.

For example, as illustrated in FIG. 3, in the pixel driving circuit provided by the embodiment of the present, the control sub-circuit 10 comprises a second thin film transistor 12 and a third thin film transistor 13, a gate electrode of the second thin film transistor 12 and a gate electrode of the third thin film transistor 13 are connected with each other, and are both connected with the control line G_N, a drain electrode of the second thin film transistor 12 is connected with the data line I_oled, a source electrode of the second thin film transistor 12 and a drain electrode of the third thin film transistor 13 are connected with the first node 1, and a source electrode of the third thin film transistor 13 is connected with the second node 2.

The charging sub-circuit 30 comprises a storage capacitor 15, a first end of the storage capacitor 15 is connected with the first node 1, a second end of the storage capacitor 15 is connected with the third node 3, and the third node 3 is connected with the second power supply Vss.

The driving sub-circuit 20 comprises a first thin film transistor 11, a gate electrode of the first thin film transistor 11 is connected with the first node 1, a source electrode of the first thin film transistor 11 is connected with the third node 3, and a drain electrode of the first thin film transistor 11 is connected with the second node 2.

The light-emitting sub-circuit 40 comprises a light-emitting component 16, a cathode of the light-emitting component 16 is connected with the second node 2, and an anode of the light-emitting component 16 is connected with the first power supply Vdd.

For example, the light-emitting component 16 may be an organic light-emitting diode.

In the embodiments of the present disclosure, the first power supply Vdd is at a high level with respect to the second power supply Vss. That is, a level of the first power supply Vdd is higher than a level of the second power supply Vss.

For example, in the embodiment of the present disclosure, the first thin film transistor 11, the second thin film transistor 12 and the third thin film transistor 13 are N-type thin film transistors. However, the present disclosure is not limited to this case, and the thin film transistor 11, the second thin film transistor 12 and the third thin film transistor 13 may also be P-type thin film transistors.

For example, in the pixel driving circuit provided by an embodiment of the present disclosure, in a writing stage, the control line G_N provides a high level signal, so that the second thin film transistor 12 and the third thin film transistor 13 are turned on, the data line I_oled provides a signal current; and the signal current is written into the gate electrode of the first thin film transistor 11 after flowing through the second thin film transistor 12; the third thin film transistor 13 is turned on, so that the first node 1 and the second node 2 are short-circuited, and due to a self-regulating effect of the first thin film transistor 11, the signal current charges the storage capacitor 15 via the drain electrode and the source electrode of the first thin film transistor 11; in addition, the signal current flows into the second power supply Vss through the drain electrode and the source electrode of the first thin film transistor 11. The first power supply Vdd does not provide a signal, that is, the first power supply Vdd is floating, so that the first power supply Vdd, the first thin film transistor 11, the light-emitting component 16 and the second power supply Vss can not form a loop, and the light-emitting component 16 does not emit light.

In a light-emitting stage, the control line G_N provides a low level signal, so that the second thin film transistor 12 and the third thin film transistor 13 are turned off; due to the charge retention effect of the storage capacitor 15, the storage capacitor 15 provides a high level signal to the gate electrode of the first thin film transistor 11, so that the first thin film transistor 11 remains to be turned on, and the drain electrode and the source electrode of the first thin film transistor 11 are connected with each other, at this time, the current flowing through the light-emitting component 16 is a turn-on current of the first thin film transistor 11 (that is, the signal current during the writing stage). The first power supply Vdd provides a high level signal, the first power supply Vdd, the first thin film transistor 11, the light-emitting component 16 and the second power supply Vss form a loop, and the light-emitting component 16 emits light.

Figure 4:
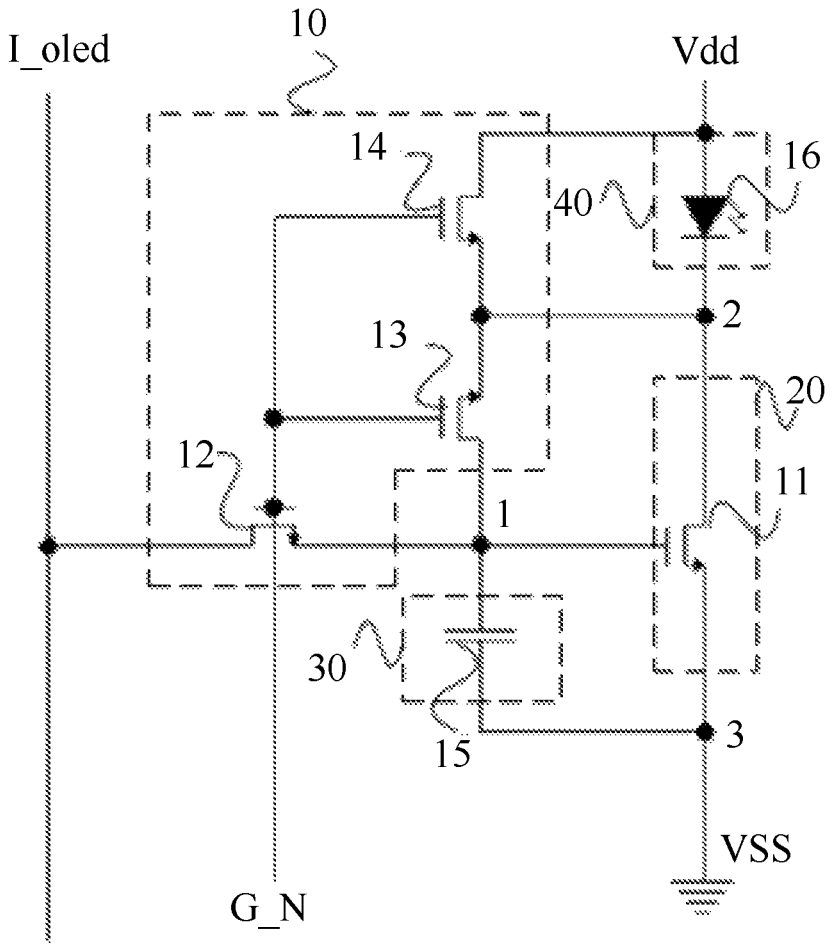
FIG. 4 is a structural schematic diagram of a pixel driving circuit provided by another embodiment of the present disclosure.

It can be seen that the driving sub-circuit provided in the embodiment of the present disclosure merely comprises the first thin film transistor, therefore, it is beneficial to reduce the power load and decrease power consumption; in addition, because only the control line G_N and the data line I_oled are provided, no additional signal control lines need to be added, so the wire routing of the circuit structure is simpler, thus the manufacturing process is simplified, the yield rate is improved, FIG. 4 is a structural schematic diagram of a pixel driving circuit provided by another embodiment of the present disclosure.

For example, as illustrated in FIG. 4, compared with the pixel driving circuit provided by the embodiment illustrated in FIG. 3, the control sub-circuit 10 of the pixel driving circuit provided by the embodiment illustrated in FIG. 4 further comprises a fourth thin film transistor 14, a gate electrode of the fourth thin film transistor 14 is connected with a gate electrode of the second thin film transistor 12 and a gate electrode of the third thin film transistor 13, a source electrode of the fourth thin film transistor 14 is connected with the second node 2; and a drain electrode of the fourth thin film transistor 14 is connected with the first power supply Vdd.

For example, the first thin film transistor 11, the second thin film transistor 12, the third thin film transistor 13 and the fourth thin film transistor 14 may be N-type thin film transistors or P-type thin film transistors.

For example, in the pixel driving circuit provided by the embodiment of the present disclosure, in the writing stage, the control line G_N provides a high level signal, so that the second thin film transistor 12, the third thin film transistor 13 and the fourth thin film transistor 14 are turned on, the fourth thin film transistor 14 short-circuits the light-emitting component 16, thus the light-emitting component 16 does not emit light. The data line I_oled provides the signal current, and the signal current is written into the gate electrode of the first thin film transistor 11 after flowing through the second thin film transistor 12, the third thin film transistor 13 is turned on, so that the first node 1 and the second node 2 are short-circuited; due to the self-regulating effect of the first thin film transistor 11, and the first power supply Vdd is floating, the signal current charges the storage capacitor 15 via the drain electrode and the source electrode of the first thin film transistor 11, and the signal current can flow into the second power supply Vss through the drain electrode and the source electrode of the first thin film transistor 11.

In a light-emitting stage, the control line G_N provides a low level signal, so that the second thin film transistor 12, the third thin film transistor 13 and the fourth thin film transistor 14 are turned off; due to the charge retention effect of the storage capacitor 15, the storage capacitor 15 provides a high level signal to the gate electrode of the first thin film transistor 11, so that the first thin film transistor 11 remains to be turned on, and the drain electrode and the source electrode of the first thin film transistor 11 are connected with each other, at this time, the current flowing through the light-emitting component 16 is a turn-on current of the first thin film transistor 11 (that is, the signal current during the writing stage). The first power supply Vdd provides a high level signal, the first power supply Vdd, the first thin film transistor 11, the light-emitting component 16 and the second power supply Vss form a loop, and the light-emitting component 16 emits light.

It can be seen that the driving sub-circuit provided in the embodiment of the present disclosure merely comprises the first thin film transistor, therefore, it is beneficial to reduce the power load and decrease power consumption; in addition, because only the control line and the data line are provided, no additional signal control lines need to be added, so the wire routing of the circuit structure is simpler, thus the manufacturing process is simplified and the yield rate is improved.

In the pixel driving circuit provided by an embodiment of the present disclosure, the control sub-circuit further comprises the fourth thin film transistor, so the stability of the circuit is improved, it is beneficial to the stable light emission of the light-emitting device, and the display brightness uniformity of the display is ensured.

Figure 5:
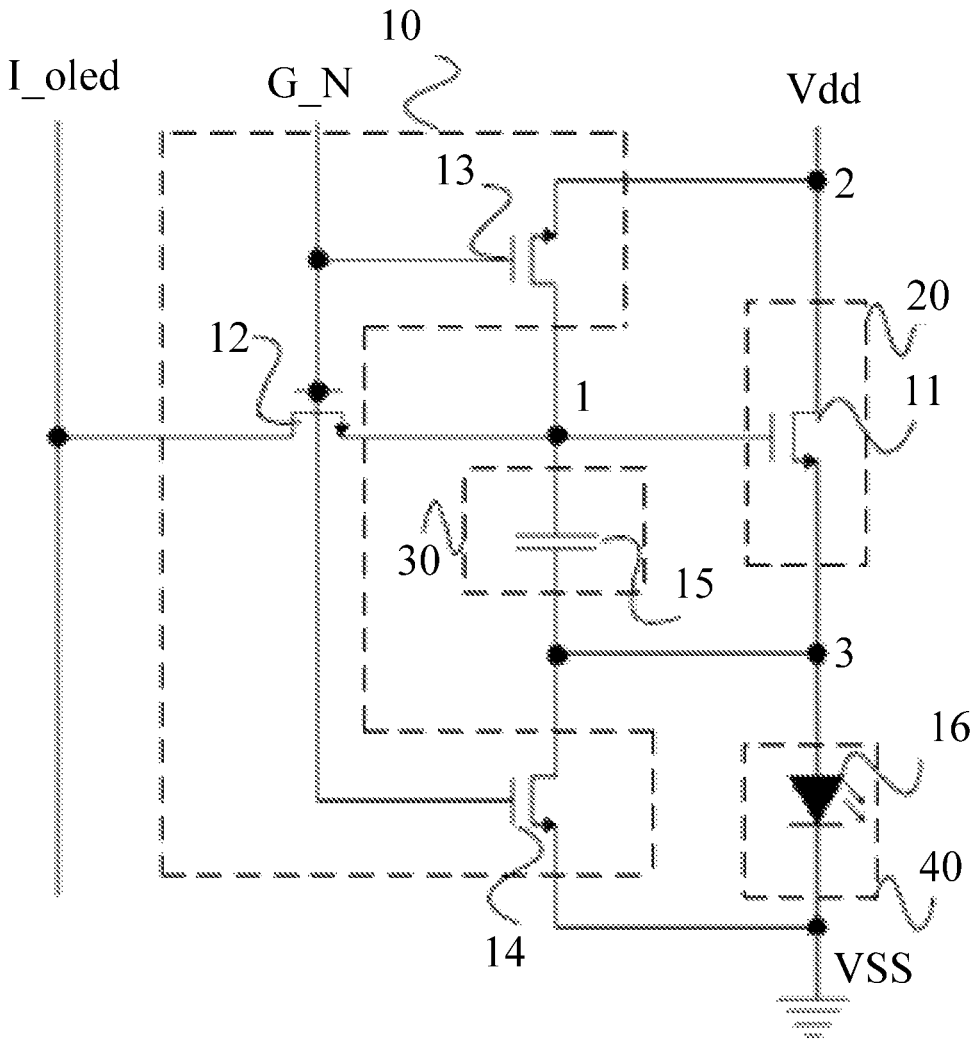
FIG. 5 is a structural schematic diagram of a pixel driving circuit provided by still another embodiment of the present disclosure.

FIG. 5 is a structural schematic diagram of a pixel driving circuit provided by still another embodiment of the present disclosure.

For example, as illustrated in FIG. 5, in the pixel driving circuit provided by an embodiment of the present disclosure, the control sub-circuit 10 comprises a second thin film transistor 12, a third thin film transistor 13 and a fourth thin film transistor 14. A gate electrode of the second thin film transistor 12, a gate electrode of the third thin film transistor 13 and a gate electrode of the fourth thin film transistor 14 are connected, and are connected with the control line G_N as well; a drain electrode of the second thin film transistor 12 is connected with the data line I_oled; a source electrode of the second thin film transistor 12 and a drain electrode of the third thin film transistor 13 are connected with the first node 1; a source electrode of the third thin film transistor 13 is connected with the second node 2; the second node 2 is connected with the first power supply Vdd; a drain electrode of the fourth thin film transistor 14 is connected with the third node 3, and a source electrode of the fourth thin film transistor 14 is connected with the second power supply Vss.

For example, in the embodiment of the present disclosure, the light-emitting sub-circuit 40 comprises a light-emitting component 16, an anode of the light-emitting component 16 is connected with the third node 3, and a cathode of the light-emitting component 16 is connected with the second power supply Vss.

For example, the light-emitting component 16 may be an organic light-emitting diode.

For example, in the embodiment of the present disclosure, the charging sub-circuit 30 comprises a storage capacitor 15, a first end of the storage capacitor 15 is connected with the first node 1, and a second end of the storage capacitor 15 is connected with the third node 3.

The driving sub-circuit 20 comprises a first thin film transistor 11. A gate electrode of the first thin film transistor 11 is connected with the first node 1, a source electrode of the first thin film transistor 11 is connected with the third node 3, and a drain electrode of the first thin film transistor 11 is connected with the second node 2.

For example, the first thin film transistor 11, the second thin film transistor 12, the third thin film transistor 13 and the fourth thin film transistor 14 may be N-type thin film transistors or P-type thin film transistors.

For example, in the pixel driving circuit provided by the embodiment of the present disclosure, in the writing stage, the control line G_N provides a high level signal, so that the second thin film transistor 12, the third thin film transistor 13 and the fourth thin film transistor 14 are turned on, the fourth thin film transistor 14 short-circuits the light-emitting component 16, thus the light-emitting component 16 does not emit light. The data line I_oled provides the signal current, and the signal current is written into the gate electrode of the first thin film transistor 11 after flowing through the second thin film transistor 12, the third thin film transistor 13 is turned on, so that the first node 1 and the second node 2 are short-circuited; due to the self-regulating effect of the first thin film transistor 11 and the first power supply Vdd being floating, the signal current charges the storage capacitor 15 via the drain electrode and the source electrode of the first thin film transistor 11, and the signal current can flow into the second power supply Vss through the drain electrode and the source electrode of the first thin film transistor 11 and through the drain electrode and the source electrode of the fourth thin film transistor 14.

In a light-emitting stage, the control line G_N provides a low level signal, so that the second thin film transistor 12, the third thin film transistor 13 and the fourth thin film transistor 14 are turned off; the storage capacitor 15 provides a high level signal to the gate electrode of the first thin film transistor 11, so that the first thin film transistor 11 remains to be turned on, and the drain electrode and the source electrode of the first thin film transistor 11 are connected with each other; at this time, the current flowing through the light-emitting component 16 is a turn-on current of the first thin film transistor 11 (that is, the signal current during the writing stage). The first power supply Vdd provides a high level signal, the first power supply Vdd, the first thin film transistor 11, the light-emitting component 16 and the second power supply Vss form a loop, and the light-emitting component 16 emits light.

It can be seen that the driving sub-circuit provided in the embodiment of the present disclosure merely comprises the first thin film transistor, therefore, it is beneficial to reduce the power load and decrease power consumption; in addition, because only the control line G_N and the data line I_oled are provided, no additional signal control lines need to be added, so the wire routing of the circuit structure is simpler, thus the manufacturing process is simplified and the yield rate is improved.

In the pixel driving circuit provided by the embodiment of the present disclosure, the driving sub-circuit further comprises the fourth thin film transistor, so that the stability of the circuit is improved, it is beneficial to the stable light emission of the light-emitting device, and the display brightness uniformity of the display is ensured.

In the pixel driving circuit provided by an embodiment of the present disclosure, cathodes of all the light-emitting components on the display panel are commonly connected to the second power supply Vss, a mode of common cathode makes it easier to ensure the product yield than a mode of common anode in the manufacturing process.

Figure 6:
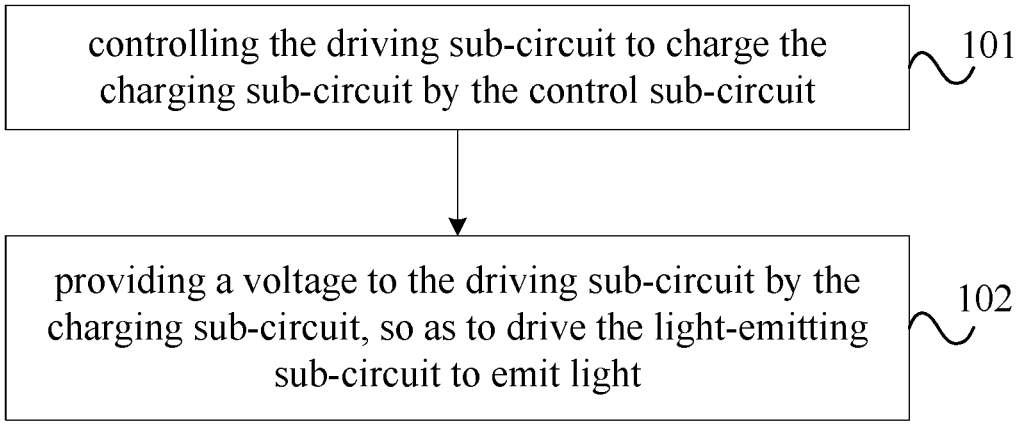
FIG. 6 is a flowchart of a driving method of a pixel driving circuit provided by an embodiment of the present disclosure.

FIG. 6 is a flowchart of a driving method of a pixel driving circuit provided by an embodiment of the present disclosure.

Figure 7:
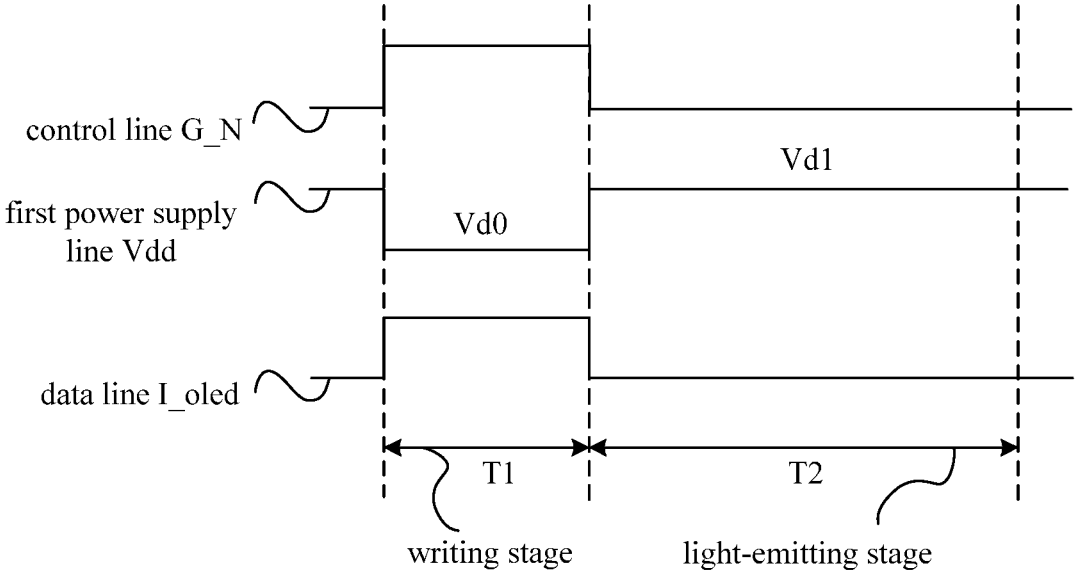
FIG. 7 is a signal timing diagram of a pixel driving circuit provided by an embodiment of the present disclosure.

FIG. 7 is a signal timing diagram of a pixel driving circuit provided by an embodiment of the present disclosure.

For example, as illustrated in FIG. 6, a driving method of the pixel circuit provided by an embodiment of the present disclosure is based on a pixel driving circuit, and the pixel driving circuit comprises a control sub-circuit, a charging sub-circuit, a driving sub-circuit, a light-emitting sub-circuit, and a first power supply. The driving method comprises the following operations:

Step 101, controlling the driving sub-circuit to charge the charging sub-circuit by the control sub-circuit; and Step 102, providing a voltage to the driving sub-circuit by the charging sub-circuit so as to drive the light-emitting sub-circuit to emit light.

In practical applications, the pixel driving circuit can be at a non-light emitting stage (a writing stage) and a light emitting stage, and the writing stage is a stage of charging the charging sub-circuit.

For example, as illustrated in FIG. 7, the signal timing of the embodiment of the present disclosure comprises a scan signal timing of the control line G_N, a data signal timing of the data line I_oled, and a power signal timing of the first power supply Vdd. The signal timing can be divided into the writing stage and the light emitting stage.

Figure 9A:
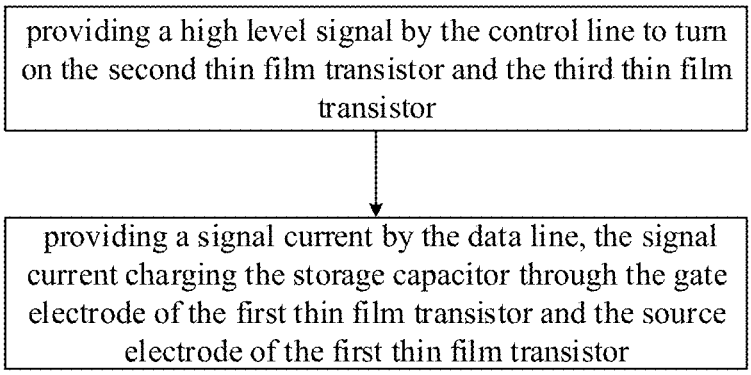
FIG. 9A is a flowchart of an example of a step 101 shown in FIG. 6.

In the embodiment illustrated in FIG. 3, the control sub-circuit 10 of the pixel driving circuit comprises a second thin film transistor 12 and a third thin film transistor 13, the driving sub-circuit 20 of the pixel driving circuit comprises a first thin film transistor 11, the charging sub-circuit 30 of the pixel driving circuit comprises a storage capacitor 15, and then as shown in FIG. 9A, the step 101 may comprise following sub-steps:

Step 11, providing a high level signal by the control line so as to turn on the second thin film transistor and the third thin film transistor; and Step 12, providing a signal current by the data line, the signal current charging the storage capacitor through a gate electrode and a source electrode.

For example, in the sub-step 11, as illustrated in FIG. 7, in the writing stage (T1), when the control line G_N provides a high level signal, as illustrated in FIG. 3, because a gate electrode of the second thin film transistor 12 and a gate electrode of the third thin film transistor 13 are both connected with the control line G_N, based on the characteristics of the thin film transistor, the second thin film transistor 12 and the third thin film transistor 13 are turned on.

For example, in the sub-step 12, as illustrated in FIG. 7, in the writing stage (T1), when the data line I_oled provides a signal current, as illustrated in FIG. 3, because the drain electrode of the second thin film transistor 12 is connected with the data line I_oled, the signal current is written into the gate electrode of the first thin film transistor 11 through the second thin film transistor 12, the third thin film transistor 13 is turned on so that the first node 1 and the second node 2 are short-circuited; due to a self-regulating effect of the first thin film transistor 11, the signal current charges the storage capacitor 15 via the drain electrode and the source electrode of the first thin film transistor 11. The signal current flows into the second power supply Vss through the drain electrode and the source electrode of the first thin film transistor 11.

For example, in the sub-step 12, as illustrated in FIG. 7, in the writing stage (T1), the first power supply Vdd can provide a low level signal Vd0 (such as, Vd0=0). It should be noted that, in the sub-step 12, the first power supply Vdd may also not provide a signal, that is, the first power supply Vdd is floating.

Figure 9B:
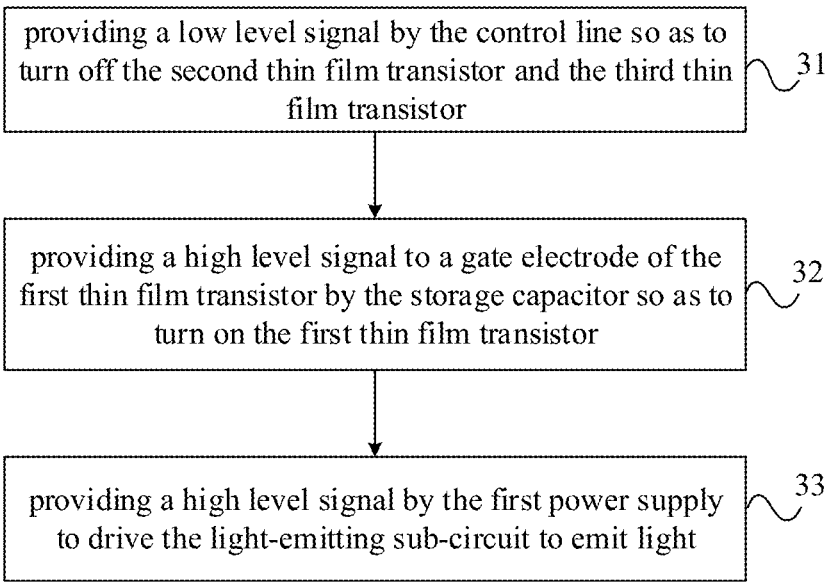
FIG. 9B is a flowchart of an example of a step 102 shown in FIG. 6.
Figure 9C:
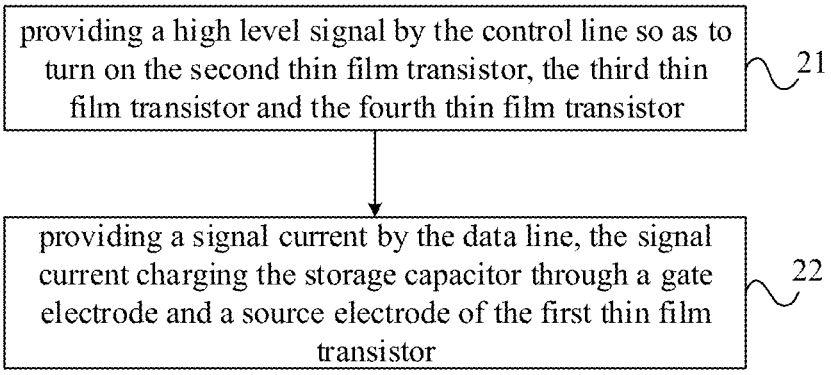
FIG. 9C is a flowchart of another example of a step 101 shown in FIG. 6.

In the embodiments illustrated in FIG. 4 and FIG. 5, the control sub-circuit 10 of the pixel driving circuit comprises a second thin film transistor 12, a third thin film transistor 13 and a fourth thin film transistor 14, the driving sub-circuit 20 of the pixel driving circuit comprises a first thin film transistor 11, the charging sub-circuit 30 of the pixel driving circuit comprises a storage capacitor 15, and then, as shown in FIG. 9C, the step 101 may comprise following sub-steps:

Step 21, providing a high level signal by the control line so as to turn on the second thin film transistor, the third thin film transistor and the fourth thin film transistor;

Step 22, providing a signal current by the data line, the signal current charging the storage capacitor through a gate electrode and a source electrode of the first thin film transistor.

For example, in the sub-step 21, as illustrated in FIG. 7, in the writing stage (T1), when the control line G_N provides a high level signal, as illustrated in FIG. 4 and FIG. 5, because a gate electrode of the second thin film transistor 12, a gate electrode of the third thin film transistor 13 and a gate electrode of the fourth thin film transistor 14 are connected with the control line G_N, and based on the characteristics of the thin film transistor, the second thin film transistor 12, the third thin film transistor 13 and fourth thin film transistor 14 are turned on.

For example, in the sub-step 22, as illustrated in FIG. 7, in the writing stage (T1), when the data line I_oled provides a signal current, as illustrated in FIG. 4 and FIG. 5, because the drain electrode of the second thin film transistor 12 is connected with the data line I_oled, the signal current is written into the gate electrode of the first thin film transistor 11 through the second thin film transistor 12; the third thin film transistor 13 is turned on, so that the first node 1 and the second node 2 are short-circuited; due to a self-regulating effect of the first thin film transistor 11, the signal current charges the storage capacitor 15 via the drain electrode and the source electrode of the first thin film transistor 11. The signal current flows into the third node 3 through the drain electrode and the source electrode of the first thin film transistor 11, and finally the signal current flows into the second power supply Vss.

For example, in the sub-step 22, in the writing stage (T1), the first power supply Vdd does not provide a level signal, that is, the first power supply Vdd is floating.

In the embodiment illustrated in FIG. 3, the control sub-circuit 10 of the pixel driving circuit comprises a second thin film transistor 12 and a third thin film transistor 13, the driving sub-circuit 20 of the pixel driving circuit comprises a first thin film transistor 11, the charging sub-circuit 30 of the pixel driving circuit comprises a storage capacitor 15, and then, as shown in FIG. 9B, the step 102 may comprise following sub-steps:

S31, providing a low level signal by the control line so as to turn off the second thin film transistor and the third thin film transistor;

S32, providing a high level signal to a gate electrode of the first thin film transistor by the storage capacitor so as to turn on the first thin film transistor;

S33, providing a high level signal by the first power supply to drive the light-emitting sub-circuit to emit light.

For example, as illustrated in FIG. 7, in the light-emitting stage (T2), the control line G_N provides a low level signal, so that the second thin film transistor 12 and the third thin film transistor 13 are turned off; due to the discharge effect of the storage capacitor 15, the storage capacitor 15 can provide a high level signal to the gate electrode of the first thin film transistor 11, so that the first thin film transistor 11 remains to be turned on, and the drain electrode and the source electrode of the first thin film transistor 11 are connected with each other, the turn-on current of the first thin film transistor 11 is the signal current flowing through the drain electrode and the source electrode of the first thin film transistor 11 during the writing stage; at this time, the first power supply Vdd provides a high level signal, thus the first power supply Vdd, the first thin film transistor 11, the light-emitting component 16 and the second power supply Vss form a loop so as to drive the light-emitting component 16 of the light-emitting sub-circuit 40 to emit light.

Figure 9D:
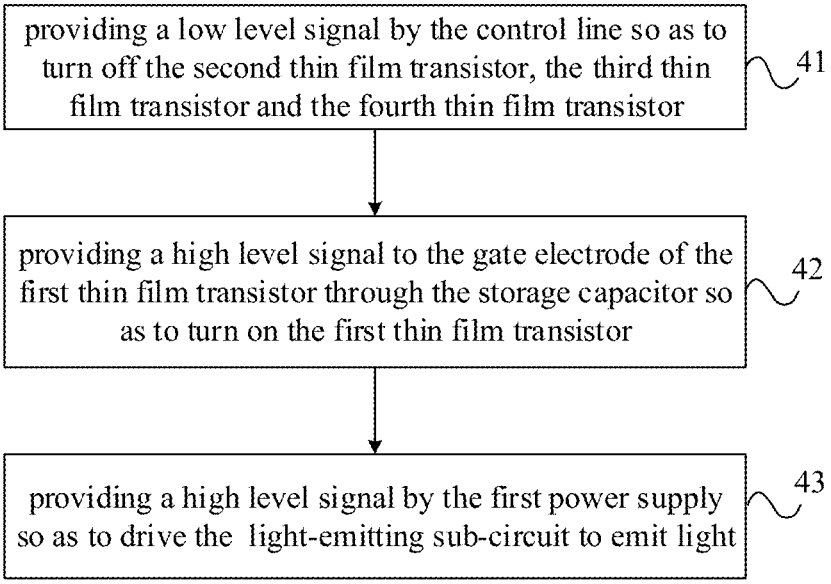
FIG. 9D is a flowchart of another example of a step 102 shown in FIG. 6.

In the embodiments illustrated in FIG. 4 and FIG. 5, the control sub-circuit 10 of the pixel driving circuit comprises a second thin film transistor 12, a third thin film transistor 13 and a fourth thin film transistor 14, the driving sub-circuit 20 of the pixel driving circuit comprises a first thin film transistor 11, the charging sub-circuit 30 of the pixel driving circuit comprises a storage capacitor 15, and then, as shown in FIG. 9D, the step 102 may comprise following sub-steps:

S41, providing a low level signal by the control line so as to turn off the second thin film transistor, the third thin film transistor and the fourth thin film transistor;

S42, providing a high level signal to the gate electrode of the first thin film transistor through the storage capacitor so as to turn on the first thin film transistor;

S43, providing a high level signal by the first power supply so as to drive the light-emitting sub-circuit to emit light.

For example, as illustrated FIG. 7, in the light-emitting stage (T2), the control line G_N provides a low level signal, the second thin film transistor 12, the third thin film transistor 13 and the fourth thin film transistor 14 are turned off; due to a discharge effect of the storage capacitor 15, the storage capacitor 15 can provide a high level signal to the gate electrode of the first thin film transistor 11, so that the first thin film transistor 11 remains to be turned on, and the drain electrode and the source electrode of the first thin film transistor 11 are connected with each other, the turn-on current of the first thin film transistor 11 is the signal current flowing through the drain electrode and the source electrode of the first thin film transistor 11 during the writing stage; at this time, the first power supply Vdd provides a high level signal Vd1, thus the first power supply Vdd, the first thin film transistor 11, the light-emitting component 16 and the second power supply Vss form a loop so as to drive the light-emitting component 16 of the light-emitting sub-circuit 40 to emit light.

In the driving method of the pixel driving circuit provided by the embodiment of the present disclosure, the driving sub-circuit of the pixel driving circuit merely comprises the first thin film transistor, and therefore, it is beneficial to reduce the power load and decrease power consumption; in addition, because only the control line G_N and the data line I_oled are provided, no additional signal control lines need to be added, the wire routing of the circuit structure is simpler, the manufacturing process is simplified, the yield rate is improved, and the timing signals are reduced.

In some embodiments of the present disclosure, cathodes of all the light-emitting components on the display panel are commonly connected to the second power supply Vss, a mode of common cathode makes it easier to ensure the product yield than a mode of common anode in the manufacturing process.

Figure 8:
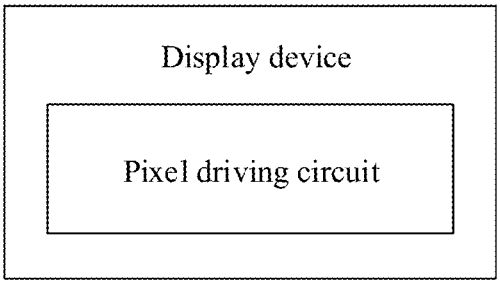
FIG. 8 is a schematic diagram of a display device provided by an embodiment of the present disclosure.

FIG. 8 is a schematic diagram of a display device provided by an embodiment of the present disclosure. An embodiment of the present disclosure further comprises a display device. As shown in FIG. 8, the display device comprises any one of the pixel driving circuits described above. The driving sub-circuit of the pixel driving circuit merely comprises the first thin film transistor, therefore, it is beneficial to reduce the power load and decrease power consumption; in addition, because only the control line G_N and the data line I_oled are provided, no additional signal control lines need to be added, the wire routing of the circuit structure is simpler, the manufacturing process is simplified, the yield rate is improved, and the timing signals of the display device are reduced.

For the above various embodiments of methods, in order to describe simply, the methods are described as a series of operation combinations in each embodiment, however, those skilled in the art should understand that the present disclosure is not limited by the sequence of the described operations, because according to the present disclosure, some steps may be performed in other orders or simultaneously. Secondly, those skilled in the art should also understand that the embodiments described in the specification are particular embodiments, and the involved operations and modules are not necessarily required by the present disclosure.

Each embodiment in the specification is described in a progressive manner, each embodiment focuses on the differences from other embodiments, and the same or similar parts among the various embodiments can be referred to each other.

The pixel driving circuit, the display device and the driving method provided by the present disclosure are described above in detail, specific embodiments are used herein to describe the principles and implementations of the present disclosure, the description of the above embodiments is only used to facilitate the understand to the methods and main ideas of the present disclosure; in addition, those of ordinary skill in the art, based on the ideas of the present disclosure, can make some changes in specific implementation manners and application ranges, in summary, the contents of the specification should not be construed as limitation upon the present disclosure.

What is claimed is:

1. A pixel driving circuit, comprising: a control sub-circuit, a charging sub-circuit, a driving sub-circuit, and a light-emitting sub-circuit, wherein the control sub-circuit is connected with a data line and a control line, and the control sub-circuit is connected with the driving sub-circuit through a first node and a second node;

the charging sub-circuit is connected with the driving sub-circuit through the first node and a third node;

a first end of the light-emitting sub-circuit is connected with the driving sub-circuit, and a second end of the light-emitting sub-circuit is connected with a first power supply or a second power supply;

the driving sub-circuit comprises a first thin film transistor;

the control sub-circuit is configured to control the first thin film transistor to charge the charging sub-circuit through the first node and the third node, the charging sub-circuit is configured to provide a voltage to the driving sub-circuit through the first node, and the driving sub-circuit is configured to drive the light-emitting sub-circuit to emit light;

the charging sub-circuit comprises a storage capacitor, a first end of the storage capacitor is directly connected with the first node, a second end of the storage capacitor is connected with the third node, a gate electrode of the first thin film transistor of the driving sub-circuit is directly connected with the first node, a source electrode of the first thin film transistor is connected with the third node, and a drain electrode of the first thin film transistor is connected with the second node;

the control sub-circuit comprises a second thin film transistor and a third thin film transistor, a gate electrode of the second thin film transistor and a gate electrode of the third thin film transistor are connected with each other, and are both connected with the control line;

a drain electrode of the second thin film transistor is connected with the data line;

a source electrode of the second thin film transistor and a drain electrode of the third thin film transistor are directly connected with the first node; and a source electrode of the third thin film transistor is connected with the second node.

2. The pixel driving circuit according to claim 1, wherein the third node is connected with the second power supply.

3. The pixel driving circuit according to claim 1, wherein the light-emitting sub-circuit comprises a light-emitting component, a cathode of the light-emitting component is connected with the second node, and an anode of the light-emitting component is connected with the first power supply.

4. The pixel driving circuit according to claim 3, wherein the control sub-circuit further comprises a fourth thin film transistor, a gate electrode of the fourth thin film transistor, the gate electrode of the second thin film transistor, and the gate electrode of the third thin film transistor are connected;

a source electrode of the fourth thin film transistor is connected with the second node; and a drain electrode of the fourth thin film transistor is connected with the first power supply.

5. The pixel driving circuit according to claim 1, wherein the control sub-circuit further comprises a fourth thin film transistor, a gate electrode of the fourth thin film transistor, the gate electrode of the second thin film transistor, and the gate electrode of the third thin film transistor are connected;

a source electrode of the fourth thin film transistor is connected with the second node; and a drain electrode of the fourth thin film transistor is connected with the first power supply.

6. The pixel driving circuit according to claim 1, wherein the control sub-circuit further comprises a fourth thin film transistor;

a gate electrode of the fourth thin film transistor is connected with the control line;

the second node is connected with the first power supply; and a drain electrode of the fourth thin film transistor is connected with the third node, and a source electrode of the fourth thin film transistor is connected with the second power supply.

7. The pixel driving circuit according to claim 6, wherein the light-emitting sub-circuit comprises a light-emitting component, an anode of the light-emitting component is connected with the third node, and a cathode of the light-emitting component is connected with the second power supply.

8. A display device, comprising the pixel driving circuit according to claim 1.

9. A driving method of a pixel driving circuit, wherein the driving method is based on the pixel driving circuit, the pixel driving circuit comprises a control sub-circuit, a charging sub-circuit, a driving sub-circuit, a light-emitting sub-circuit, and a first power supply, the control sub-circuit comprises a second thin film transistor and a third thin film transistor, the driving sub-circuit comprises a first thin film transistor, the charging sub-circuit comprises a storage capacitor, a first end of the storage capacitor is directly connected with a first node, a second end of the storage capacitor is connected with a third node, a gate electrode of the first thin film transistor is directly connected with the first node, a source electrode of the first thin film transistor is connected with the third node, and a drain electrode of the first thin film transistor is connected with a second node;

a gate electrode of the second thin film transistor and a gate electrode of the third thin film transistor are connected with each other, and are both connected with a control line;

a drain electrode of the second thin film transistor is connected with a data line;

a source electrode of the second thin film transistor and a drain electrode of the third thin film transistor are directly connected with the first node; and a source electrode of the third thin film transistor is connected with the second node, the driving method comprises:

controlling the driving sub-circuit to charge the charging sub-circuit by the control sub-circuit; and providing a voltage to the driving sub-circuit by the charging sub-circuit so as to drive the light-emitting sub-circuit to emit light.

10. The driving method according to claim 9, wherein the controlling the driving sub-circuit to charge the charging sub-circuit by the control sub-circuit comprises:

providing a high level signal by the control line to turn on the second thin film transistor and the third thin film transistor; and providing a signal current by the data line, the signal current charging the storage capacitor through the gate electrode of the first thin film transistor and the source electrode of the first thin film transistor.

11. The driving method according to claim 10, wherein the providing the voltage to the driving sub-circuit by the charging sub-circuit so as to drive the light-emitting sub-circuit to emit light comprises:

providing a low level signal by the control line so as to turn off the second thin film transistor and the third thin film transistor;

providing a high level signal to the gate electrode of the first thin film transistor by the storage capacitor so as to turn on the first thin film transistor; and providing a high level signal by the first power supply so as to drive the light-emitting sub-circuit to emit light.

12. The driving method according to claim 9, wherein the control sub-circuit further comprises a fourth thin film transistor, the controlling the driving sub-circuit to charge the charging sub-circuit by the control sub-circuit comprises:

providing a high level signal by the control line so as to turn on the second thin film transistor, the third thin film transistor, and the fourth thin film transistor; and providing a signal current by the data line, the signal current charging the storage capacitor through the gate electrode of the first thin film transistor and the source electrode of the first thin film transistor.

13. The driving method according to claim 12, wherein the providing the voltage to the driving sub-circuit by the charging sub-circuit so as to drive the light-emitting sub-circuit to emit light comprises:

providing a low level signal by the control line so as to turn off the second thin film transistor, the third thin film transistor, and the fourth thin film transistor;

providing a high level signal to the gate electrode of the first thin film transistor through the storage capacitor so as to turn on the first thin film transistor; and providing a high level signal by the first power supply so as to drive the light-emitting sub-circuit to emit light.

* * * * *